United States Patent [19]

Rathmell

[11] 4,043,059

[45] Aug. 23, 1977

[54] SKI BOOT-IMPROVED MEANS TO CHANGE FLEXIBILITY

[76] Inventor: Richard Kenneth Rathmell, 12 Pinetree Road, Ramsey, N.J. 07446

[21] Appl. No.: 682,291

[22] Filed: May 3, 1976

[51] Int. Cl.[2] ..... A43B 5/04
[52] U.S. Cl. ..... 36/121
[58] Field of Search ..... 36/120, 121, 117

[56] References Cited

U.S. PATENT DOCUMENTS

| | | | |
|---|---|---|---|
| 3,535,800 | 10/1970 | Stohr | 36/120 |
| 3,786,581 | 1/1974 | Mochizuki | 36/121 |
| 3,832,792 | 9/1974 | Kastinger | 36/117 |
| 3,968,578 | 7/1976 | Rathmell | 36/121 |

*Primary Examiner*—Patrick D. Lawson

[57] ABSTRACT

An improved means for quickly making a major change in the flexibility of a ski boot is provided with a detachable stiffening member that interlocks with relatively rigid fins which extend from a flexible section of the boot.

8 Claims, 4 Drawing Figures

SKI BOOT-IMPROVED MEANS TO CHANGE FLEXIBILITY

CROSS REFERENCES Applicants prior U.S. Pats. Nos. 3,968,578 and 3,988,842.

BACKGROUND

Most ski boots manufactured for down-hill skiing represent a compromise between being as stif as is desirable for high-performance down-hill skiing and being as comfortable as is desirable for comfort in walking and stride-type skiing. There are some ski boot designs and patents which describe means for adjusting ski boot rigidity, but in each case there is some limitation or disadvantage. It is an object of this invention to make it more practical and convienent for a skier to make a major change in the flexibility of the boot.

DESCRIPTION OF THE INVENTION

Figure 1:
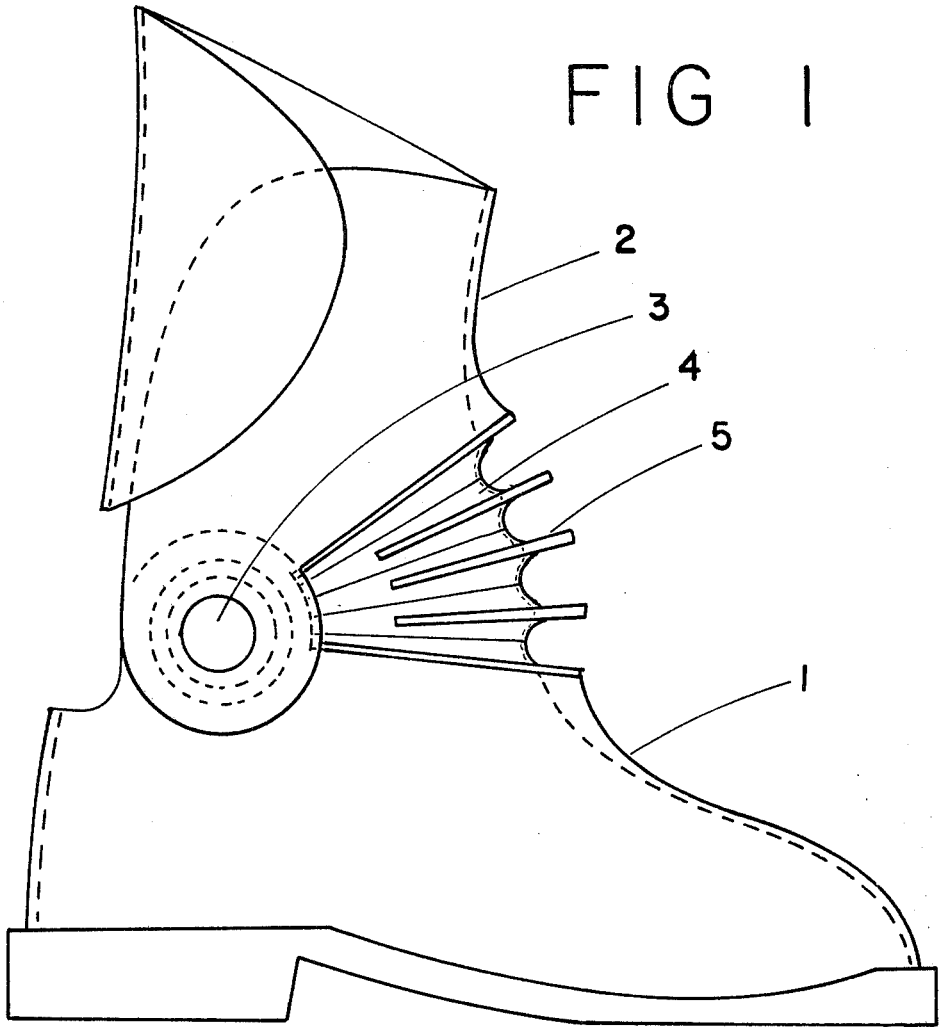
FIG. 1 is a side view of the ski boot showing a hinge member.

As shown in FIG. 1, the ski boot of the present invention has a number of basic elements which have been previously described, including:

a. a foot-covering section 1 b. a leg-holding section 2 c. hinges 3 that connect the leg-holding section to the foot-covering section d. a flexible corrugated section 4 in front of the hinges between the leg-holding section and the foot-covering section. The lines of the corrugations extend around the boot from hinge to hinge to enhance the flexibility of this section.

Figure 2:
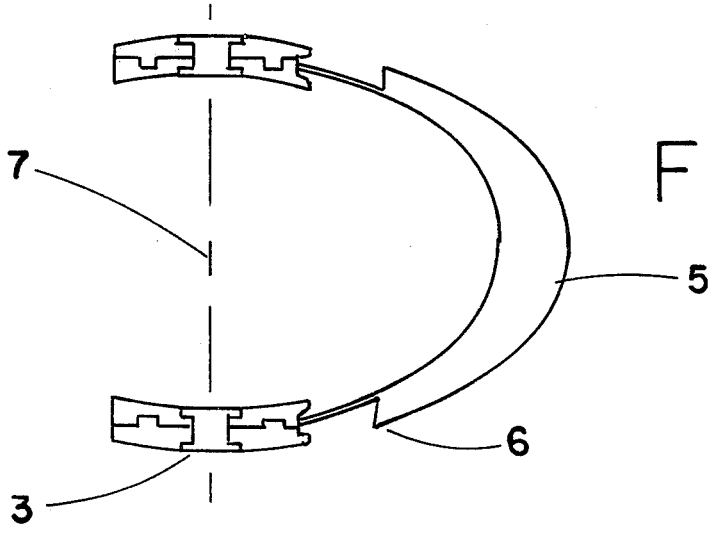
FIG. 2 is an elevational view of the hinge.

A unique feature of the subject boot is a number of relatively rigid fins 5 that project from the external crease lines of the corrugations. The fins do not interfere with the flexibility of the boot until the leg-holding section is strained so far forward that the fins are pressed into contact with each other. Each of the fins is essentially the same size and shape when there is more than one fin on the boot. Each fin has a top surface and a bottom surface. The bottom surface of the bottom fin is opposite and facing a corresponding surface on the top of the foot-covering section. The upper surface of the upper fin is opposite and facing a corresponding surface on the leg-holding section of the boot. From two to four fins are usually preferred, but a single fin or more than four may be used within the scope of this invention. As shown in FIG. 2, which is a view of a horizontal section taken through the hinges and one fin, the fins may resemble part of a horseshoe reaching around the front of the skier's ankle, and the fins may terminate with a relatively sharp edge 6.

Figure 3:
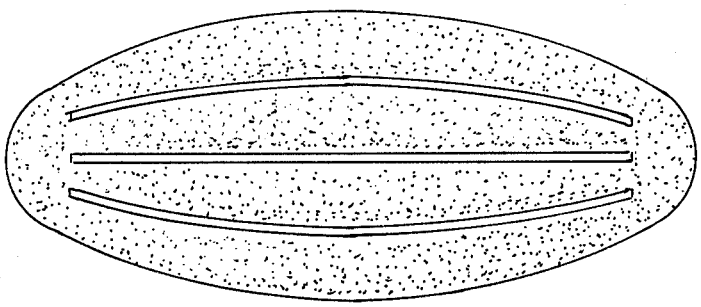
FIG. 3 shows a detachable stiffening member.
Figure 4:
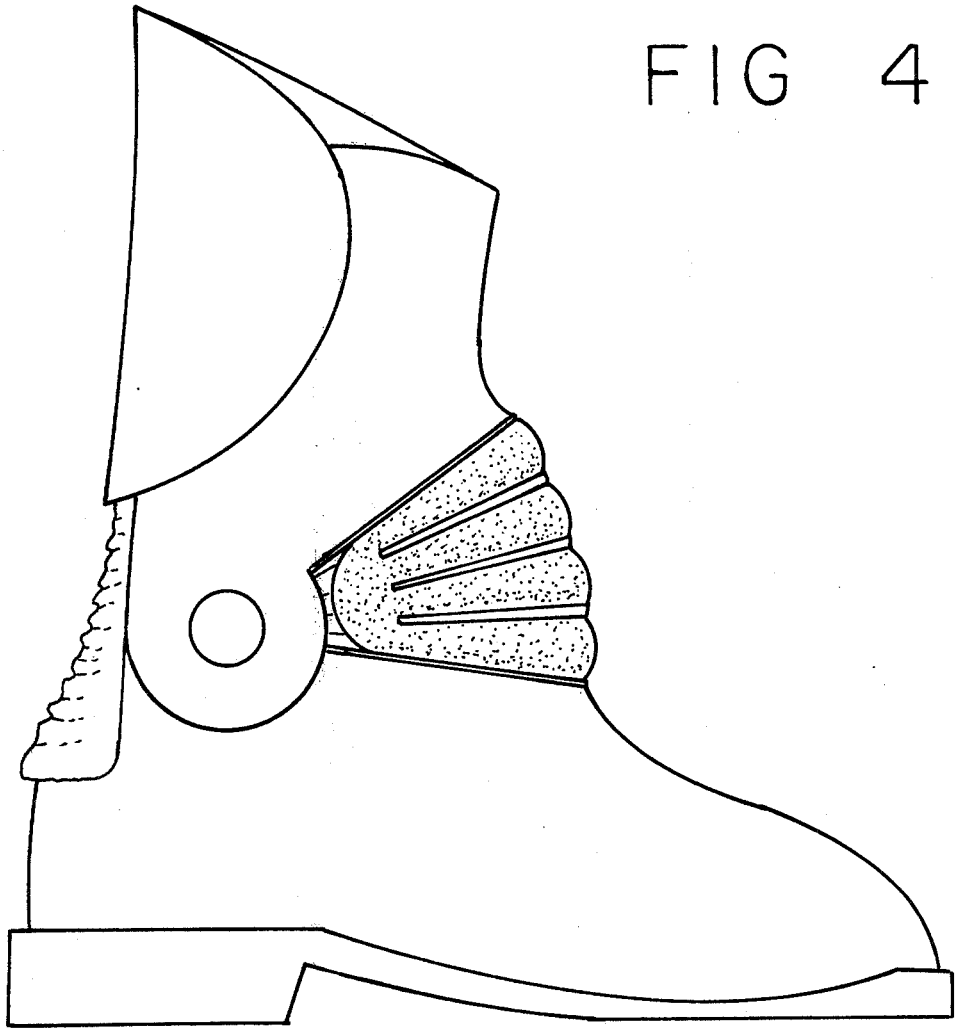
FIG. 4 is a side view of a ski boot with the stiffening member thereon.

The purpose of the fins is to engage and hold a detachable stiffening member as illustrated in FIG. 3. FIG. 4 shows a side view of the boot with the stiffening member in a functioning position. The stiffening member may be constructed from a variety of materials, depending on the compression characteristics preferred. A closed cell elastic foam is relatively "quick and lively" to regain its shape after the skier presses forward in the boot. Alternatively, it may be constructed of a shock-dampening foam such as an open cell urethane foam. A higher density foam can make the boot stiffer than a less dense foam. The variety of materials that may be used to stiffen the boot include pneumatic tubes and inflatable devices, rubber or elastomeric shapes, cords, ropes, straps, etc.

A preferred stiffening member is shaped as illustrated in FIG. 3 with a number of slits provided through which the fins may protrude as shown in FIG. 4. Such a member may be stretched into a functioning position between the fins and the ends of the fins 6 can be the means to retain the member in this position until the skier stretches it off. It may be carried in a jacket pocket with convience and safety because of its flexible nature when it is made of an elastomeric foam material.

It can be appreciated that the rigid fins maintain an alignment when the flexible section of the boot is compressed, and that without this alignment being maintained a soft stiffening member would pop out of a compression-resisting position when the skier leans forward in the boot.

It is obvious that this system of rigid fins and a detachable stiffening member will be effective when the hinges on the ski boot are of the molded elastomeric type, as described in the copending application (Ser. No. 588,204), instead of being the conventional pivoted type as illustrated here. When the boot and hinges are integrally molded with the flexible section and the fins, the fins maintain a better alignment under high stress.

It is obvious that means other than the ends of the fins 6 may be used to hold a stiffening member in a functioning position. Cords or straps may extend around the ankle or be attached to the hinge or other parts of the boot.

The improvement over the related prior art is important in the degree of change of flexability that can be achieved and in the degree of convenience. For instance, the Hanson Boot as illustrated in U.S. Pat. No. 3,807,060 utilizes a plurality of "flex rods", each of which must be turned 90° to effect a small change in flexibility. Even if the skier were to totally remove all flex rods and replace them the change in flexability would be relatively small. Likewise, the Kastinger Boot as illustrated in U.S. Pat. No. 3,832,792 utilizes a plurality of openings in the shell of the boot into which some elastic inserts can be fitted. It does not appear as though these inserts can be slipped in and out with convenience on a ski trail, and if they were to be removed and carried in the skier's pocket, it appears as though the boot would be substantially stiffer than the hinged boot of this application.

In comparison with a prior Rathmell Boot as illustrated in U.S. Pat. No. 3,968,578 (Ser. No. 588,203), which utilizes a semi-rigid removable stiffening member, the stiffening member of the this application can be relatively soft and better suited to be pocketed. The soft stiffening member as illustrated in FIG. 3 of this application may be pressed and stretched into a functioning position, and subsequently removed, by a skier wearing gloves or mittens out on a mountain ski trail.

It may be seen that each rigid fin is supported by a relatively thin part of the flexible corrugated section, and therefore any one fin may be displaced to some extent from its alignment with the corresponding surfaces. However, the shape of each fin and its surface area is such that when the stiffening member is in a functioning position and stressed in compression, no one fin can move so far out of alignment that its force-transmitting function is impaired. When the fins are stacked equal distant from the axis of the hinge they can transmit the compressive forces through a relatively great angle, and thereby allow the boot to be relatively more flexible when the stiffening member is not in a functioning position.

What is claimed is:

1. A ski boot which by itself is relatively flexible in the forward-backward direction, but can be stiffened by the addition of a removable stiffening member, said boot having elements that include:

a. a foot-covering section,
b. a leg-holding section,
c. hinges or flexible elements on each side of the boot connecting the leg-holding section to the foot-covering section,
d. a flexible corrugated section across the front of the boot between the leg-holding section and the foot-covering section, wherein the lines of the corrugations extend across the front of the boot in planes that intersect approximately along the axis of the hinges or flexible elements, and the boot can be identified by the presence of relatively rigid fins projecting from the external crease lines of the corrugations in the flexible section, said fins being in planes that intersect approximately along the said axis, wherein the fins themselves do not interfere with the flexibility of the flexible corrugated section when the leg-holding section is strained forward relative to the foot-covering section, but the fins are useful in association with a removable stiffening member that may be positioned between the fins to stiffen the boot.

2. A ski boot which by itself is very flexible in the forward-backward direction, but can be stiffened by the addition of a removable stiffening member, said boot having elements that include:

a. a foot-covering section,
b. a leg-holding section,
c. hinges that connect the leg-holding section to the foot-covering section,
d. a flexible corrugated section in front of the hinges between the leg-holding section and the foot-covering section, wherein the lines of the corrugations extend across the boot, essentially from hinge to hinge, and the boot may be identified by the presence of relatively rigid fins projecting from the external crease lines of the corrugations in the flexible section, wherein each fin has a distinct top surface and a distinct bottom surface, and the top surface of the top fin is opposite and facing a corresponding surface on the leg-holding section, and the bottom surface of the bottom fin is opposite and facing a corresponding surface on the upper part of the foot-covering section, and each surface of each fin if opposite and facing a similar surface which is essentially equal in size and equal in distance from the axis of the hinges, and these surfaces may be pressed toward each other when the the leg-holding section is strained forward relative to the foot-covering section, and the said surfaces are useful in association with a removable compression-resistant stiffening member that may be compressed between the said surfaces when the leg-holding section is strained forward.

3. A ski boot which by itself is very flexible in the forward-backward direction, but can be stiffened by the addition of a removable stiffening member, said boot having elements that include:

a. a foot-covering section,
b. a leg-holding section,
c. hinges that connect the leg-holding section to the foot-covering section,
d. a flexible corrugated section in front of the hinges between the leg-holding section and the foot-covering section, wherein the lines of the corrugations extend across the boot, essentially from hinge to hinge, and the boot may be identified by the presence of one or more relatively rigid fins projecting from the external crease lines of the corrugations in the flexible section, wherein each fin has a distinct top surface and a distinct bottom surface, and each fin extends across the front of the boot and part way back toward the hinges, and the ends of the fins terminate relatively sharply with edges that project toward the opposite side of the boot.

4. An elastic stiffening member in combination with a ski boot, said member adapted to be conveniently positioned in a functioning position on the ski a ski boot, or to be conveniently removed, wherein the ski boot itself is relatively flexible in a forward-backward direction and the ski boot has elements which include:

a. a foot-covering section,
b. a leg-holding section,
c. hinges that connect the leg-holding section to the foot-covering section,
d. a flexible corrugated section in front of the hinges between the leg-holding section and the foot-covering section, wherein the lines of the corrugations extend across the front of the boot, essentially from hinge to hinge,
e. one or more relatively rigid fins extending from the external crease lines of the corrugations in the flexible section, and the elastic stiffening member is formed so that the said fins may protrude through slitted apertures in the stiffening member when the said member is positioned in a functioning position.

5. An elastic stiffening member in combination with a ski boot as in claim 4, wherein the said member is formed from a resilient foamed type of elastomeric material.

6. An elastic stiffening member in combination with a ski boot as in claim 4, wherein the said member is formed from a shock-dampening type of elastomeric material.

7. An elastic stiffening member in combination with a ski boot as in claim 4, wherein the slitted apertures are normally slightly shorter than the length of the rigid fins, but the stiffening member may be stretched into a functioning position with the fins protruding through the apertures.

8. A ski boot which by itself is very flexible in the forward-backward direction, but can be stiffened by the addition of a removable stiffening member, said boot having elements that include:

a. a foot-covering section,
b. a leg-holding section,
c. hinges that connect the leg-holding section to the foot-covering section,
d. a flexible corrugated section in front of the hinges between the leg-holding section and the foot-covering section, wherein the lines of the corrugations extend across the front of the boot, essentially from hinge to hinge, and the boot may be identified by the presence of relatively rigid fins projecting from the external crease lines of the corrugations in the flexible section, wherein each fin has a distinct top surface and a distinct bottom surface, and the top surface of the top fin is opposite and facing a corresponding surface on the leg-holding section, and the bottom surface of the bottom fin is opposite and facing a corresponding surface on the upper part of the foot-covering section, and each such surface of each fin is opposite and facing a similar surface which is essentially equal in size and distance from the axis of the hinges, and each fin extends across the front of the boot and part way back toward the hinges, and the ends of the fins terminate relatively sharply with edges that project toward the opposite side of the boot, and the said surfaces may be pressed toward each other when the leg-holding section is strained forward relative to the foot-holding section, and the said surfaces are useful in association with a removable compression-resistant stiffening member that may be positioned between the said surfaces, and the stiffening member is formed with slitted apertures through which the fins may extend.

* * * * *